US005163593A

United States Patent [19]

Yamashita

[11] Patent Number: 5,163,593

[45] Date of Patent: Nov. 17, 1992

[54] CLAMPER OF PAPER FEED TRACTOR

[75] Inventor: Masashi Yamashita, Aichi, Japan

[73] Assignee: Tokai Kogyo Kabushiki Kaisha, Aichi, Japan

[21] Appl. No.: 758,497

[22] Filed: Sep. 5, 1991

Related U.S. Application Data

[63] Continuation of Ser. No. 487,851, Mar. 5, 1990, abandoned.

[30] Foreign Application Priority Data

Mar. 13, 1989 [JP] Japan ..... 1-60223

[51] Int. Cl.[5] ..... B65H 20/20

[52] U.S. Cl. ..... 226/74; 400/616.1

[58] Field of Search ..... 400/616, 616.1, 616.2; 226/74, 75; 279/1 TE, 71, 81; 403/350, 351, 409.1, 374

[56] References Cited

U.S. PATENT DOCUMENTS

| | | | |
|---|---|---|---|
| 2,603,496 | 7/1952 | Richert | 279/71 |
| 3,773,371 | 11/1973 | Carlsson | 403/351 X |
| 4,129,239 | 12/1978 | Hubbard | 226/75 |
| 4,315,585 | 2/1982 | Seitz | 226/74 |
| 4,361,196 | 11/1982 | Moyle, Jr. | 403/351 X |
| 4,391,399 | 7/1983 | Seitz | 226/74 |
| 4,437,463 | 7/1984 | Hubbard et al. | 226/74 |
| 4,569,468 | 2/1986 | Neer | 400/616.1 X |
| 4,585,367 | 4/1986 | Gall | 403/351 X |
| 4,735,352 | 4/1988 | Ueno et al. | 226/74 |
| 4,780,013 | 10/1988 | Sakai | 400/616.2 |
| 4,790,466 | 11/1988 | Ueno et al. | 226/74 |
| 4,819,849 | 4/1989 | Seitz | 226/74 |
| 4,819,849 | 4/1989 | Seitz | 226/74 |
| 4,969,263 | 9/1989 | Seitz | 226/74 |

*Primary Examiner*—Daniel P. Stodola
*Assistant Examiner*—Paul Bowen
*Attorney, Agent, or Firm*—Wenderoth, Lind & Ponack

[57] ABSTRACT

A clamp is used for clamping a paper feed tractor to a support shaft at a predetermined distance from another paper feed tractor. The clamp comprises a semi-cylindrical elongated clamp guide member which is cantilevered from a frame of the paper feed tractor, and a cylindrical clamp member rotatably mounted about the clamp guide member. The clamp guide member has a clamping inner peripheral surface adapted to complementarily engage the support shaft, a first outer peripheral surface, a second outer peripheral surface having a radius of curvature larger than the first outer peripheral surface and a sloped outer peripheral portion joining the first and second outer peripheral surfaces. The clamp member has a clamping inner peripheral surface adapted to complementarily engage the support shaft, a first inner peripheral surface, a second inner peripheral surface having a radius of curvature larger than the first inner peripheral surface, and a sloped inner peripheral portion joining the first and second inner peripheral surfaces, such that the clamp member is rotatable between a clamping position and a release position.

12 Claims, 6 Drawing Sheets

CLAMPER OF PAPER FEED TRACTOR

This application is a continuation of now abandoned application, Ser. No. 07/487,851 filed on Mar. 5, 1990.

BACKGROUND OF THE INVENTION

1. Field of the Invention

This invention relates to a clamper of a paper feed tractor for clamping and fixing a pair of paper feed tractors for feeding perforated paper to a support shaft with a gap corresponding to the width of the perforated paper.

2. Description of the Prior Art

As a conventional clamper used for the purpose described above, a clamper shown in FIGS. 10 through 12 is known conventionally.

This clamper consists of a plurality of sleeve plates 42 projecting from the outer side surface of a frame 41 that constitutes a paper feed tractor, and a cylindrical clamp member 43 fitted rotatably to the outside of these sleeve plates 42.

When the clamp member 43 fitted to the outside of the sleeve plates 42 is rotated, the sleeve plates 42 undergo deflection, and fasten and clamp a support shaft 44.

Therefore, since the support shaft 44 is clamped only partially by the tips of the sleeve plates 42, the clamp force is small. Since the plurality of sleeve plates 42 undergo deflection to thereby generate the clamp force, the sleeve plates 42 are elongated and impede the reduction of size of the paper feed tractor.

Another clamper is shown in FIGS. 13 through 15.

This clamper has a structure wherein one of the ends of a U-shaped clamp member 45 is fixed to the outer side surface of a frame 41 and a lock lever 46 causes elastic deformation of the clamp member 45 so as to hold and clamp the support shaft 44.

Accordingly, the clamp member 45 is necessary as a separate component and increases the cost of production.

Since the center of a clamp portion 45*a* of the clamp member 45 deviates from the center of the support shaft 44, the paper feed tractor is likely to incline and to clamp the support shaft 44 due to this deviation.

Moreover, the point of application of the force (F) for causing deformation of the clamp member 45 by the lock lever 46 is spaced apart by a predetermined distance (m) from the center of the support shaft 44. Accordingly, a large moment occurs around the support shaft 44 at the time of clamping so that the paper feed tractor is clamped while its driving sprocket (not shown) is firmly pressed to a driving shaft (not shown). Consequently, the frictional resistance of the rotary portion of the driving shaft increases and the driving force increases uselessly.

Still another clamper is shown in FIGS. 16 to 18.

This clamper consists of a lock lever 47 having an application portion 47*a* which is eccentric with respect to the center of the support shaft 44 and a wall plate 48 positioned in the proximity of this lock lever 47 and projecting from the frame 41.

When the application portion 47*a* of the lock lever 47 is strongly pushed into the wall plate 48, its reaction pushes and clamps the support shaft 44 from the side portion.

Consequently, a turning moment around the center (O) in the transverse direction of the paper feed tractor acts on it so that the paper feed tractor is clamped while being inclined with respect to the support shaft 44. If the paper feed tractor is obliquely clamped to the support shaft 44 in this manner, the holes of perforated paper deviate from feed pins 50 of a feed belt 49 and normal paper feed cannot be carried out.

SUMMARY OF THE INVENTION

The clamper of the paper feed tractor in accordance with the present invention includes a semi-cylindrical clamp guide member projecting from the outer side surface of the frame of the paper feed tractor and a cylindrical clamp member fitted rotatably to the outside of this clamp guide member. Two application outer peripheral surfaces having different radii are continuously formed on the outer peripheral surface of the clamp guide member along the circumferential direction. Two application inner peripheral surfaces having different radii are disposed continuously along the circumferential direction on the inner peripheral surface of the clamp member. An application inner peripheral surface formed on the clamp member and having a smaller radius is caused to run onto an application outer peripheral surface having a greater radius and formed on the clamp guide member when the clamp member fitted to the outside of the clamp guide member is rotated. A clamp force generated in this manner clamps the paper feed tractor to the support shaft with an even force along the clamp guide member. Accordingly, the semi-cylindrical clamp guide member does not undergo deflection along the longitudinal direction during the clamping but the support shaft is moved into close contact with the entire inner peripheral surface of the clamp guide member. According to this structure, the resulting clamp force becomes great and the paper feed tractor can be fixed to the support shaft without affecting the perpendicularity of the support shaft relative to the tractor. In this manner, accuracy of the paper feed tractor can be improved.

BRIEF DESCRIPTION OF THE DRAWINGS

FIGS. 1 through 9 are drawings useful for explaining the present invention, wherein:

FIG. 1 is a perspective view of a paper feed tractor to which a clamper in accordance with the present invention is fitted;

FIG. 2 is an exploded perspective view of members constituting the clamper of the present invention;

FIGS. 3 and 4 are transverse sectional views of a clamp guide member and a clamp member, respectively;

FIGS. 5 through 8 are transverse sectional views showing different states of the clamp member when it is fitted to the clamp guide member, respectively;

FIG. 9 is a transverse sectional view taken along line A—A in FIG. 8;

FIGS. 10 through 18 are drawings useful for explaining the prior art technique, wherein:

FIGS. 10 and 11 are transverse sectional views of the clamper using a clamp member in the unclamped state in the clamped state, respectively;

FIG. 12 is a sectional view taken along line B—B of FIG. 11;

FIG. 13 is a front sectional view of the paper feed tractor to which a clamper using a U-shaped clamp member is fitted;

FIGS. 14 and 15 are sectional views taken along line C—C in FIG. 13 in the unclamped state and in the clamped state, respectively;

FIGS. 16 and 17 are sectional views of a lock lever having an eccentric application portion in the unclamped state and in the clamped state, respectively; and FIG. 18 is a sectional view taken along line D—D in FIG. 17.

DESCRIPTION OF THE PREFERRED EMBODIMENT

FIGS. 1 through 9 show an embodiment of the present invention.

Figure 1:
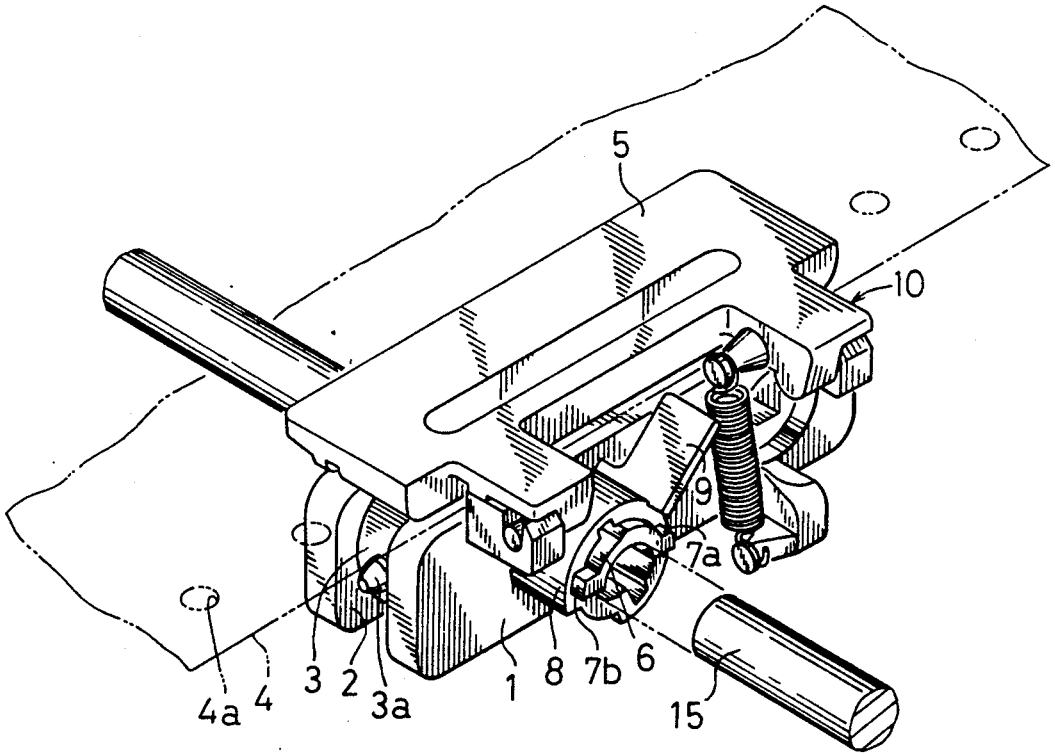
Figure 2:
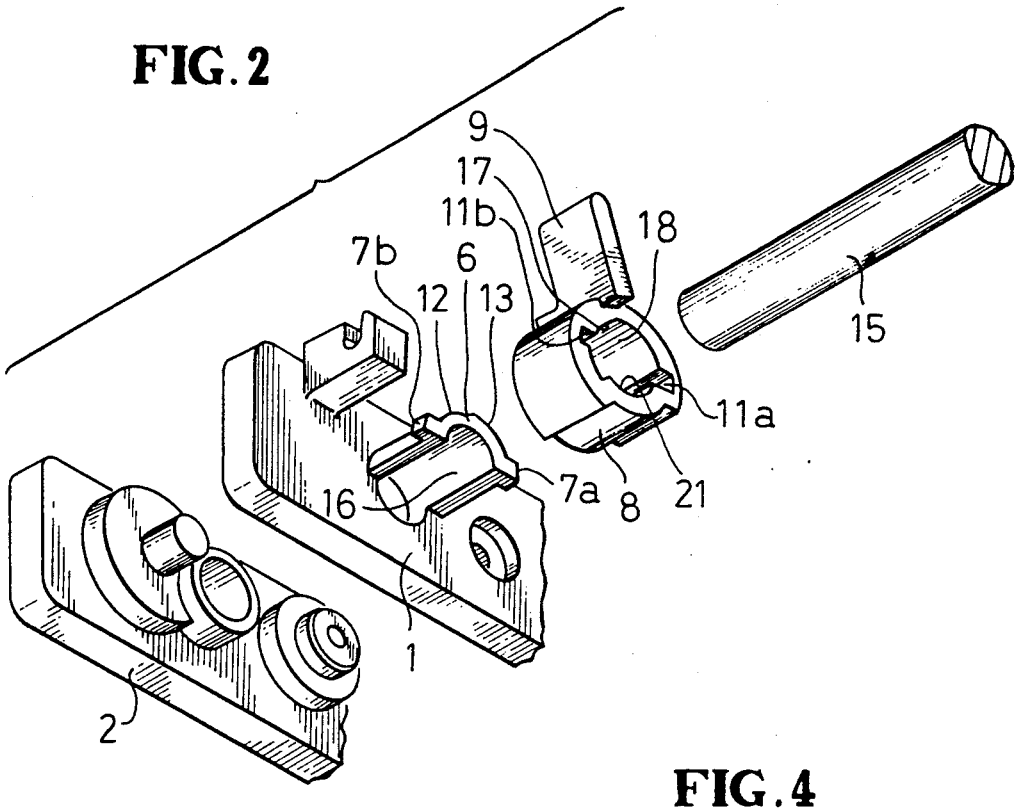

As shown in FIGS. 1 and 2, an endless belt 3 is disposed between a pair of frames 1, 2 constituting a paper feed tractor 10 and a cover 5 is fitted to one (1) of the frames for preventing floating of perforated paper 4 in such a manner as to be capable of being opened and closed. Though only one paper feed tractor 10 is shown disposed in FIG. 1, a pair of paper feed tractors 10 are fixed, in practice, to a support shaft 15 with a gap between them which corresponds to the width of the perforated paper 4 by a clamper in accordance with the present invention.

Perforated paper 4 is fed when the feed belt 3 travels circulatingly while its pins 3*a* fit into the holes 4*a* the perforated paper 4.

A semi-cylindrical clamp guide member 6 projects perpendicularly from the outer side surface of one(1) of the frames with respect to the side surface of the frame 1. A pair of fall-off prevention protuberances 7*a*, 7*b* project outwardly from both respective end portions in the radial direction at the tip of the clamp guide member 6.

A cylindrical clamp member 8 is rotatably fitted to the outside of the clamp guide member 6 described above. A lever 9 for rotation is fitted to this clamp member 8 and a pair of insertion grooves 11*a*, 11*b* are formed in an axial direction at the opposed portions of the inner peripheral surface of the clamp member 8. The positions of formation of these insertion grooves 11*a*, 11*b* correspond to the positions of the pair of fall-off prevention protuberances 7*a*, 7*b* projecting from the clamp guide member 6.

Figure 3:
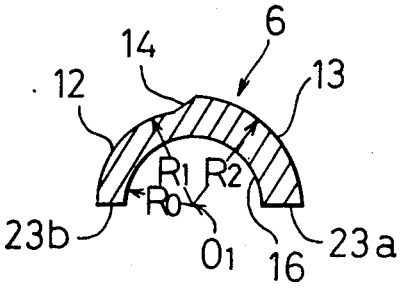

As shown in FIGS. 2 and 3, a first application outer peripheral surface 12 having a radius ($R_1$) and a second application outer peripheral surface 13 having a radius ($R_2$) are formed continuously in the circumferential direction through a gentle step 14 on the outer peripheral surface of the clamp guide member 6. A clamp inner peripheral surface 16 having a radius ($R_0$) equal to the radius of the support shaft 15 is formed on the inner peripheral surface of the clamp guide member 6.

The centers of ($O_1$) radius of the first and second application outer peripheral surfaces 12, 13 and the center of the clamp inner peripheral surface 16 are common to one another.

Figure 4:
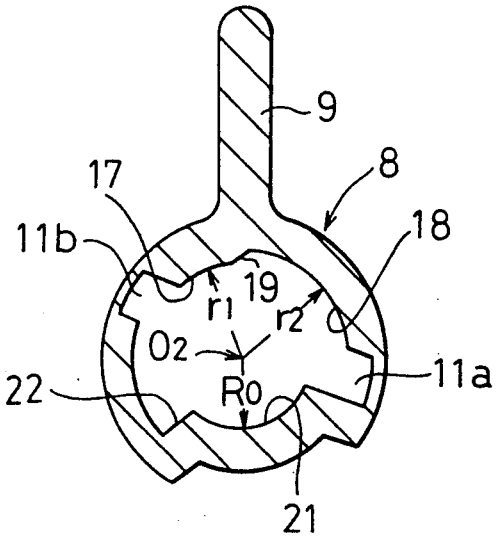

As shown in FIGS. 2 and 4, a first application inner peripheral surface 17 having a radius ($r_1$) and a second application inner peripheral surface 18 having a radius ($r_2$) are formed continuously in the circumferential direction through a gentle step 19 on the inner peripheral surface of the clamp member 8. The insertion grooves 11*a*, 11*b* described above are formed at the formation ends of the application inner peripheral surfaces 17, 18 in the circumferential direction.

A clamp inner peripheral surface 21 having a radius ($R_0$) equal to the radius of the support shaft 15 is formed at the portion opposed to each of the first and second application inner peripheral surfaces 17, 18 on the inner peripheral surface of the clamp member 8. The clamp inner peripheral surface 21 extends circumferentially from one of the insertion grooves 11*a* to a stopper surface 22 which is formed there in the radial direction of the clamp member 8. That is, the clamp inner peripheral surface 21 does not extend to the other insertion groove 11*b*.

The centers ($O_2$) of radius of the first and second application inner peripheral surfaces 17, 18 and of the clamp inner peripheral surface 21 are common to one another.

The following relationship is established between the radius ($R_1$) of the first application outer peripheral surface 12, the radius ($R_2$) of the second application outer peripheral surface 13, the radius ($r_1$) of the first application inner peripheral surface 17, the radius ($r_2$) of the second application inner peripheral surface 18 and the radius ($R_0$) of each clamp inner peripheral surface 16, 21:

$$r_1 > R_1 > R_0$$

$$r_2 > R_2 > R_0$$

$$R_2 > r_1 (R_2 - r_1 = \Delta R)$$

FIGS. 5 through 8 show the sequence of clamping the paper feed tractor 10 to the support shaft 15 by rotating the clamp member 8 fitted to the outside of the clamp guide member 6.

Figure 5:
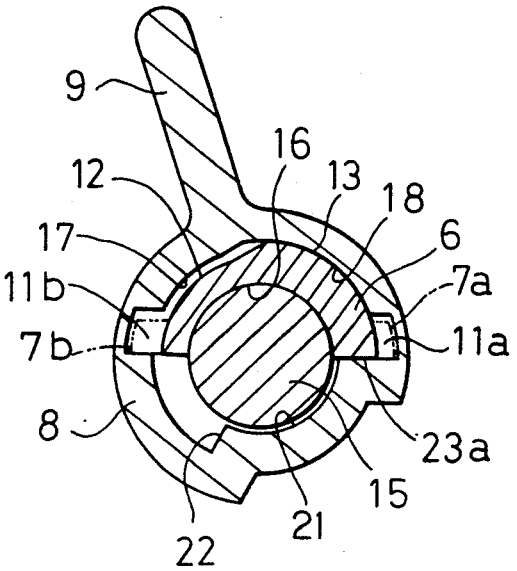

First of all, as shown in FIGS. 2 and 5, the pair of insertion grooves 11*a*, 11*b* formed on the clamp member 8 are positioned to face the pair of fall-off prevention protuberances 7*a*, 7*b* projecting from the clamp guide member 6 before the cover 5 is fitted to the frame 1 and in such a state, the clamp member 8 is pushed so that its tip surface butts against the side surface of the frame 1. Then, the pair of fall-off prevention protuberances 7*a*, 7*b* of the clamp guide member 6 pass completely through the pair of insertion grooves 11*a*, 11*b* of the clamp member 8 and the clamp member 8 is rotatably fitted to the clamp guide member 6 (see FIG. 5).

Since one of the end surfaces 23*a* of the clamp guide member 6 is in contact with the inner wall surface of one of the insertion grooves 11*a* of the clamp member 8 in this state, the clamp member 8 can rotate in only one direction.

Next, when the clamp member 8 is rotated until the lever 9 becomes substantially vertical (see FIG. 6), the step 14 disposed on the outer peripheral surface of the clamp guide member 6 and the step 19 formed on the inner peripheral surface of the clamp member 8 meet with one another, thereby forming a slight gap ($\delta$) between the outer peripheral surface of the support shaft 15 and the clamp inner peripheral surface 21 of the clamp member 8 and establishing an unclamped state. In this state, the outer end surface of the clamp member 8 is in contact with the fall-off prevention protuberances 7*a*, 7*b* projecting from the clamp guide member 6 and consequently, the clamp member 8 does not fall off of the clamp guide member 6.

Incidentally, the cover 5 is fitted to the frame 1 after the clamp member 8 is fitted to the outside of the clamp guide member 6 and is rotated by a predetermined angle. After the cover 5 is fitted to the frame 1, the clamp member 8 cannot rotate to its fitting position (the position shown in FIG. 5) due to the mutual interference between the cover 5 and the lever 9 of the clamp member 8. Accordingly, the clamp member 8 does not fall off of the clamp guide member 6 after the cover 5 is fitted to the frame 1.

Figure 6:
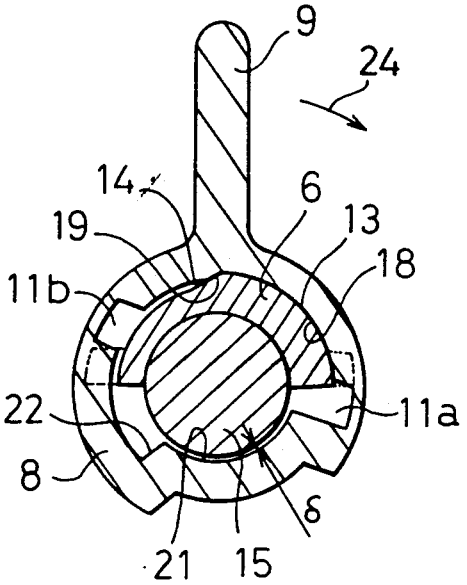
Figure 7:
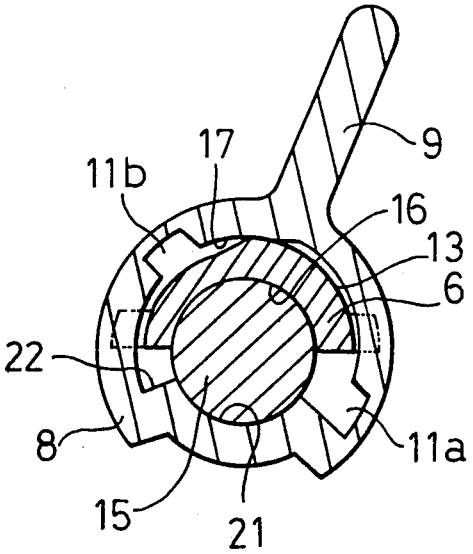

When the lever 9 of the clamp member 8 is rotated in the direction indicated by the arrow from the state shown in FIG. 6, the first application inner peripheral surface 17 formed on the clamp member 8 runs onto the second application outer peripheral surface 13 formed on the clamp guide member 6 (see FIG. 7). When the clamp member 8 is further rotated in the direction of the arrow 24, the stopper surface 22 formed on the clamp member 8 comes into contact with the other end surface 23*b* of the clamp guide member 6 (see FIG. 8) and the clamp member 8 cannot rotate any more.

Here, the relationship $[R_2 > r_1(R_2 - r_1 = \Delta R)]$ is established between the radius ($r_1$) of the first application inner peripheral surface 17 formed on the clamp member 8 and the radius ($R_2$) of the second application outer peripheral surface 13 formed on the clamp guide member 6 as described above.

Therefore, when the first application inner peripheral surface 17 formed on the clamp member 8 is caused to run onto the second application outer peripheral surface 13 formed on the clamp guide member 6, the clamp member 8 undergoes deformation by $\Delta R$ in the radial direction and a clamp force is generated. This clamp force is proportional to the difference $\Delta R$ and becomes greater if $\Delta R$ is increased.

According to the experimental results, when $\Delta R$ is set to 0.2 mm, a clamp force of 8 kg can be obtained in the axial direction on the support shaft 15 having a diameter of 7.96 mm.

When the clamp member 8 is rotated from the state shown in FIG. 6 in the direction of the arrow 24 in this manner, the clamp inner peripheral surfaces 16, 21 formed on the clamp guide member 6 and on the clamp member 8, respectively, come into close contact with the outer peripheral surface of the support shaft 15 and the paper feed tractor 10 is clamped to the support shaft 15.

Figure 8:
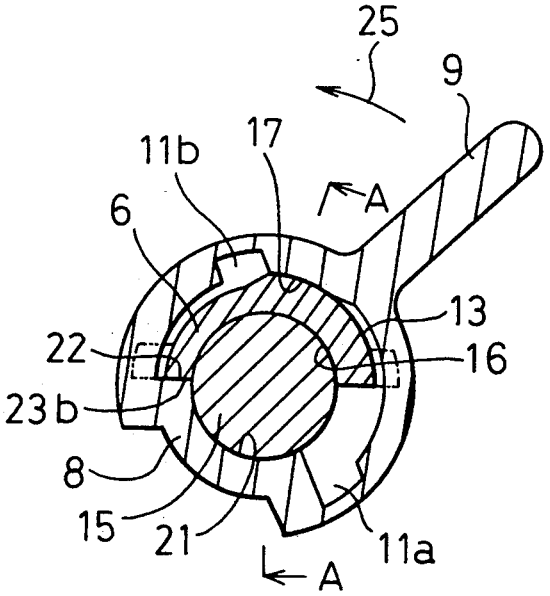
Figure 9:
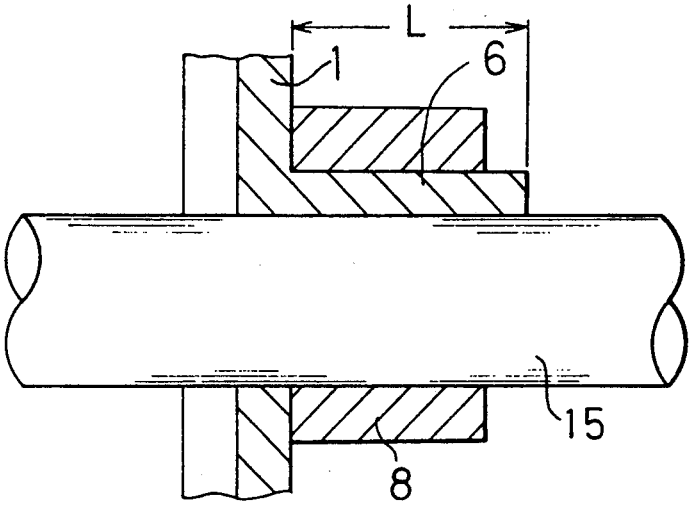
Figure 10:
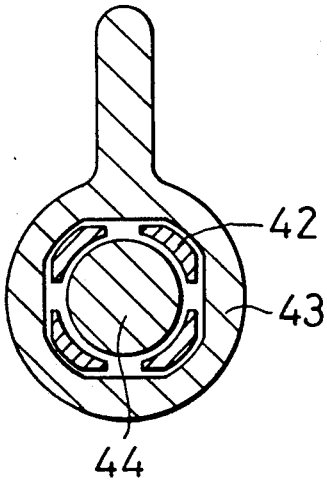
FIG. 10 PRIOR ART
Figure 11:
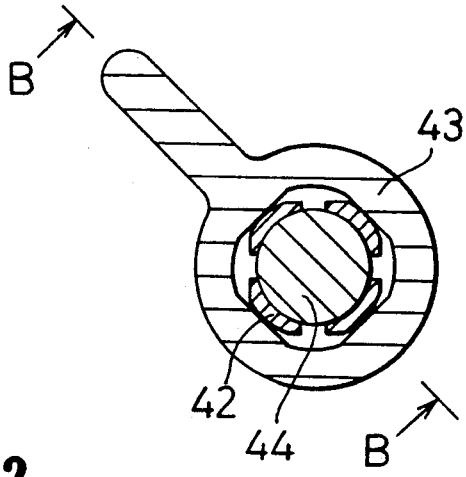
FIG. 11 PRIOR ART
Figure 12:
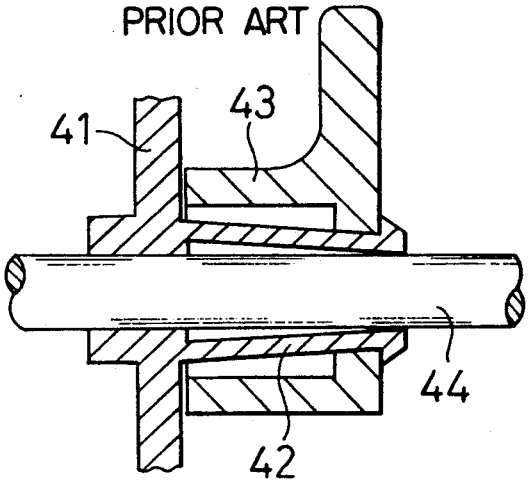
FIG. 12 PRIOR ART
Figure 13:
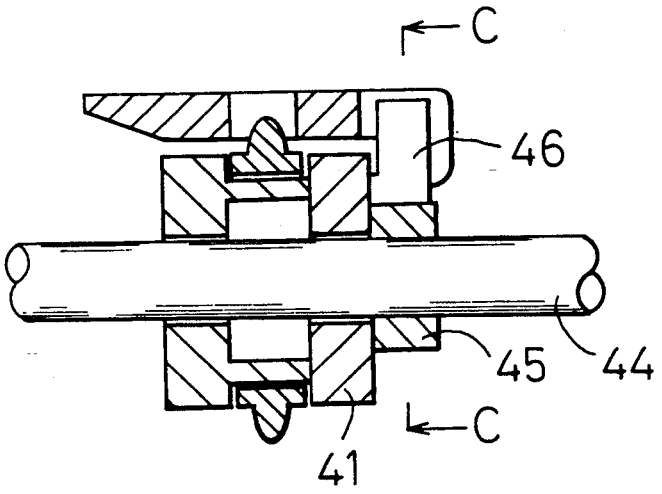
FIG. 13 PRIOR ART
Figure 14:
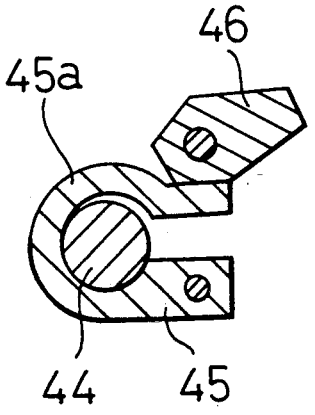
FIG. 14 PRIOR ART
Figure 15:
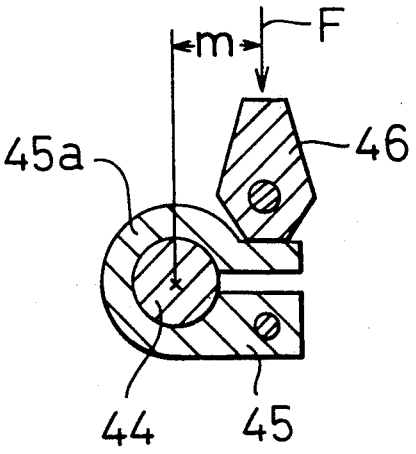
FIG. 15 PRIOR ART
Figure 16:
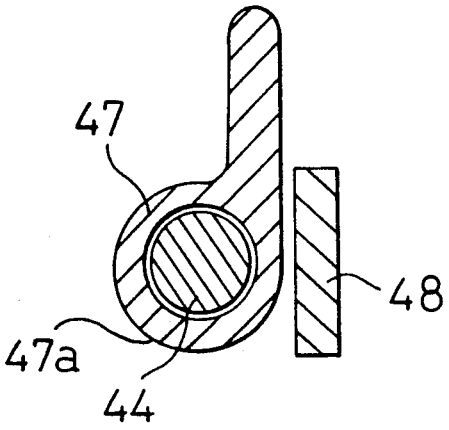
FIG. 16 PRIOR ART
Figure 17:
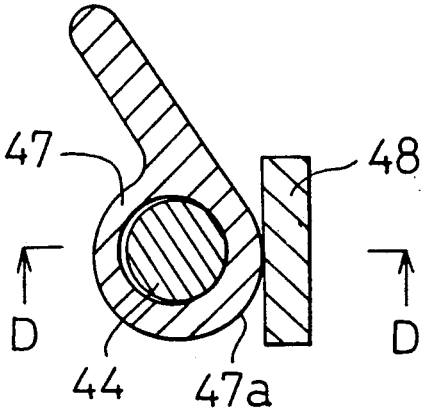
FIG. 17 PRIOR ART
Figure 18:
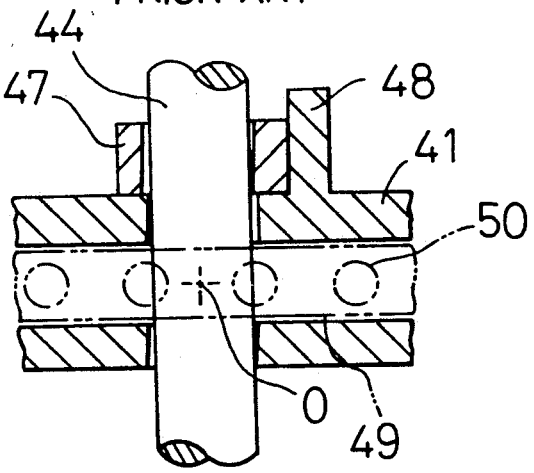
FIG. 18 PRIOR ART

The paper feed tractor attains the unclamped state when the clamp member 8 is rotated in the direction of the arrow 25 from the state shown in FIG. 8 and returned to the state shown in FIG. 6.

In the embodiment described above, the fall-off prevention means is constituted by the pair of fall-off prevention protuberances 7*a*, 7*b* projecting from the clamp guide member 6.

Since the present invention employs the above-mentioned structure wherein the clamp force is generated as the support shaft 15 comes into close contact with the entire surface of the inner peripheral surface of the semi-cylindrical clamp guide member 6, a high clamping force can be obtained and at the same time, the paper feed tractor 10 can be fixed to the support shaft 15 without forcing it away from its natural axial center (i.e., without affecting the perpendicularity of the shaft relative to the tractor. As a result, the paper feed tractor 10 can be fixed to the support shaft 15 without causing the tractor 10 to be moved into a position at an angle relative to the shaft 15. Therefore, paper feed accuracy of the paper feed tractor 10 can be improved.

Since the present invention employs the structure wherein a high clamping force is obtained as the support shaft 15 comes into close contact with the entire surface of the inner peripheral surface of the semi-cylindrical clamp guide member 6, an intended clamp force can be obtained even when the length (represented by L in FIG. 9) of the clamp guide member 6 projecting from the side surface of the frame 1 of the paper feed tractor 10 is reduced. Thus, the paper feed tractor 10 can be made compact.

Furthermore, since the present invention employs the structure wherein the clamping force is obtained without causing deflection of the clamp guide member 6 projecting from the frame 1 in the longitudinal direction, the connection of the clamp guide member 6 to the frame 1 becomes strong and strength of use the paper feed tractor 10 as a whole is increased.

What is claimed is:

1. A paper feed tractor clamp for clamping a paper feed tractor to a support shaft having a predetermined constant radius of curvature, comprising:

a substantially semi-cylindrical elongated clamp guide member having a central axis and being adapted to extend as a cantilever from a frame of the paper feed tractor in coaxial relation with the support shaft, said clamp guide member having a substantially semi-cylindrical clamping inner peripheral surface with a constant first radius of curvature substantially equal to the constant radius of curvature of the support shaft so that said clamping inner peripheral surface of said clamp guide member is adapted to complementarily engage the support shaft about a portion of the periphery of the support shaft, a first outer peripheral surface having a second radius of curvature, a second outer peripheral surface having a third radius of curvature larger than said second radius of curvature, and a sloped outer peripheral portion joining said first and second outer peripheral surfaces;

a substantially cylindrical clamp member removably rotatably mounted about said clamp guide member and having a clamping inner peripheral surface with a constant fourth radius of curvature substantially equal to said constant first radius of curvature and the constant radius of curvature of the support shaft such that said clamping inner peripheral surface of said clamp member is adapted to complementarily engage the support shaft about a portion of the periphery of the support shaft, a first inner peripheral surface with a fifth radius of curvature, a second inner peripheral surface with a sixth radius of curvature larger than said fifth radius of curvature, and a sloped inner peripheral surfaces, such that said clamp member is rotatably between a clamping position in which said second outer peripheral surface of said clamp guide member is engaged with said first inner peripheral surfaces of said clamp member and the support shaft is adapted to be clamped between said clamping inner peripheral surface of said clamp member and said clamping inner peripheral surface of said clamp guide member in such a manner as to have complementary engagement between the support shaft and each of said clamping inner peripheral surface of said clamp guide member and said clamping inner peripheral surface of said clamp member, and a release position in which said second outer peripheral surface of said clamp guide member is aligned with said second inner peripheral surface of said clamp member; and wherein said clamp guide member is substantially solid along its length such that its shape remains unchanged from when said clamp member is in its release position relative to said clamp guide member to when said clamp member is in its clamping position relative to said clamp guide member.

2. A paper feed tractor clamp as recited in claim 1, further comprising means for preventing said clamp member from falling of said clamp guide member.

3. A paper feed tractor clamp as recited in claim 2, wherein said preventing means comprises at least one radially outwardly projecting protuberance formed at a free end of said clamp guide member.

4. A paper feed tractor clamp as recited in claim 3, wherein said at least one radially outwardly projecting protuberance comprises two radially outwardly projecting protuberances formed at said free end of said clamp guide member at substantially diametrically opposite positions.

5. A paper feed tractor clamp as recited in claim 3, further comprising means for allowing said at least one protuberance to pass through said clamp member as said clamp member is mounted onto said clamp guide member.

6. A paper feed tractor clamp as recited in claim 5, wherein said means for allowing comprises at least one insertion groove formed along an inner periphery of said clamp member.

7. A paper feed tractor clamp assembly comprising:

a support shaft having a constant radius of curvature;

a tractor frame; and a tractor clamp comprising a substantially semi-cylindrical elongated clamp guide member having a central axis, extending as a cantilever from said frame, and being in coaxial relation with said support shaft, said clamp guide member having a substantially semi-cylindrical clamping inner peripheral surface with a constant first radius of curvature substantially equal to said constant radius of curvature of said support shaft so as to complementarily engage said support shaft about a portion of the periphery of said support shaft, a first outer peripheral surface having a second radius of curvature, a second outer peripheral surface having a third radius of curvature larger than said second radius of curvature, and a sloped outer peripheral portion joining said first and second outer peripheral surfaces, a substantially cylindrical clamp member removably rotatably mounted about said clamp guide member and having a clamping inner peripheral surface with a constant fourth radius of curvature substantially equal to said constant first radius of curvature and said constant radius of curvature of said support shaft so as to complementarily engage said support shaft about a portion of the periphery of said support shaft, a first inner peripheral surface with a fifth radius of curvature, a second inner peripheral surface with a sixth radius of curvature larger than said fifth radius of curvature, and a sloped inner peripheral portion joining said first and second inner peripheral surfaces, such that said clamp member is rotatable between a clamping position in which said second outer peripheral surface of said clamp guide member is engaged with said first inner peripheral surface of said clamp member and said support shaft is clamped between said clamping inner peripheral surface of said clamp member and said clamping inner peripheral surface of said clamp guide member in such a manner as to have complementary engagement between said support shaft and each of said clamping inner peripheral surface of said clamp guide member and said clamping inner peripheral surface of said clamp member, and a release position in which said second outer peripheral surface of said clamp guide member is aligned with said second inner peripheral surface of said clamp member, and wherein said clamp guide member is substantially solid along its length such that its shape remains unchanged from when said clamp member is in its release position relative to said clamp guide member to when said clamp member is in its clamping position relative to said clamp guide member.

8. A paper feed tractor clamp as recited in claim 7, further comprising means for preventing said clamp member from falling off said clamp guide member.

9. A paper feed tractor clamp as recited in claim 8, wherein said preventing means comprises at least one radially outwardly projecting protuberance formed at a free end of said clamp guide member.

10. A paper feed tractor clamp as recited in claim 9, wherein said at least one radially outwardly projecting protuberance comprises two radially outwardly projecting protuberance formed at said free end of said clamp guide member at substantially diametrically opposite position.

11. A paper feed tractor clamp as recited in claim 9, further comprising means for allowing said at least one protuberance to pass through said clamp member as said clamp member is mounted onto said clamp guide member.

12. A paper feed tractor clamp as recited in claim 11, wherein said means for allowing comprises at least one insertion groove formed along an inner periphery of said clamp member.

* * * * *